US006467756B1

(12) United States Patent
Elsasser

(10) Patent No.: US 6,467,756 B1
(45) Date of Patent: Oct. 22, 2002

(54) POST AND RAIL SYSTEM USING EXTRUDABLE PLASTIC POSTS

(75) Inventor: Glenn R. Elsasser, Winnipeg (CA)

(73) Assignee: Western Profiles Limited, Winipeg (CA)

( * ) Notice: Subject to any disclaimer, the term of this patent is extended or adjusted under 35 U.S.C. 154(b) by 0 days.

(21) Appl. No.: 09/678,407

(22) Filed: Oct. 3, 2000

Related U.S. Application Data

(63) Continuation-in-part of application No. 09/150,098, filed on Sep. 9, 1998.

(30) Foreign Application Priority Data

May 20, 1998 (CA) ..... 2238132

(51) Int. Cl.[7] ..... E04H 17/00; E04H 17/14

(52) U.S. Cl. ..... 256/65.14; 256/59; 256/65.02; 52/736.3; 248/156

(58) Field of Search ..... 256/19, 21, 22, 256/59, 64, 65, 66, 68, DIG. 5; 52/720.2, 731.2, 736.3, 737.4; 248/156

(56) References Cited

U.S. PATENT DOCUMENTS

| | | | | |
|---|---|---|---|---|
| 3,113,760 A | | 12/1963 | Huret et al. | 256/59 |
| 3,910,561 A | | 10/1975 | Fornells | 256/65 |
| 3,955,800 A | | 5/1976 | Russo | 256/59 |
| 4,326,352 A | * | 4/1982 | Barth | 248/156 X |
| 4,461,461 A | | 7/1984 | Caron | 256/19 |
| 4,520,985 A | | 6/1985 | Blumenthal | 248/530 |
| 4,702,459 A | | 10/1987 | Moschner | 256/19 |
| 4,809,955 A | | 3/1989 | Veilleux | 256/65 |
| 4,892,292 A | | 1/1990 | Russell | 256/66 |
| 4,939,877 A | | 7/1990 | Claffey | 52/155 |
| 4,958,807 A | | 9/1990 | Wylie | 256/65 |
| 5,048,995 A | | 9/1991 | Beaulieu | 403/264 |
| 5,255,899 A | | 10/1993 | von Grozny | 256/59 |
| 5,305,976 A | | 4/1994 | Blanchard | 248/156 |
| 5,471,809 A | | 12/1995 | Frankel | 52/737.4 |
| 5,601,278 A | | 2/1997 | Graber | 256/66 |
| 5,617,697 A | | 4/1997 | Erwin | 52/737.4 |
| 5,704,188 A | | 1/1998 | Coulis | 52/736.3 |
| 5,709,366 A | | 1/1998 | Speece | 248/530 |
| 5,722,205 A | | 3/1998 | Gannaway | 52/155 |
| 5,862,642 A | | 1/1999 | Erwin | 52/736.3 |
| 5,865,542 A | * | 2/1999 | Ryu | 248/161 X |

FOREIGN PATENT DOCUMENTS

| | | | |
|---|---|---|---|
| CA | 1028182 | | 3/1978 |
| CA | 1287730 | | 8/1991 |
| DE | 4306402 | * | 8/1994 |

* cited by examiner

*Primary Examiner*—Lynne H. Browne
*Assistant Examiner*—Ernesto Garcia
(74) *Attorney, Agent, or Firm*—Jones, Tullar & Cooper, P.C.

(57) ABSTRACT

A support for a hollow post of the type used to support horizontal rails for railing or fencing systems, and having a hollow, constant cross-section, the support comprising a rigid support member, such as a steel pipe, having upper and lower end portions, the lower end portion adapted to be fixed in vertical position while the upper end portion extends within the hollow post. At least one spacer, preferably extruded from plastic material or aluminum, has a tubular portion with an inner bore sized to snugly receive the rigid support member, and has longitudinal protrusions, for example ribs, ribs projecting outwardly from the tubular portion and suitable for firm engagement within internal cavity of the post. The ribs provide clear spaces between the post wall and the tubular portion which are suitable for receiving end portions of the rails when inserted into apertures formed in side walls of the post.

11 Claims, 6 Drawing Sheets

POST AND RAIL SYSTEM USING EXTRUDABLE PLASTIC POSTS

CROSS-REFERENCE TO RELATED APPLICATION

This application is a continuation-in-part of patent application Ser. No. 09/150,098 filed Sep. 9, 1998.

BACKGROUND OF THE INVENTION

1. Field of the Invention

The present invention relates to a post and rail system which may be used as a railing system for decks, or may be used as fencing. The system makes use of extrudable plastic posts and rails, and provides improved means for supporting the posts which include a pipe projecting upwardly and a special spacer for locating the post on the pipe. The supporting pipe may be a length of galvanised steel pipe commonly available from hardware stores.

2. Prior Art

Hollow posts, often made of plastic materials, are known for use in deck railing systems, and for fences. In the decking field, commonly the posts have been connected directly at their sides or bases to wooden parts of the decking, for example by bolts, but such connection means lack firmness and strength.

In some cases, both for rails and fencing, hollow posts have been supported by a rigid support member having a lower portion securely held by a ground fixture or part of the decking, and having an upper portion extending within the post.

The following patents show examples of such constructions:

- U.S. Pat. No. 3,910,561, which issued Oct. 7, 1975 to Fornells;
- U.S. Pat. No. 4,461,461, which issued Jul. 24, 1984 to Caron;
- U.S. Pat. No. 4,702,459, which issued Oct. 27, 1987 to Moschner;
- U.S. Pat. No. 4,809,955, which issued Mar. 7, 1989 to Veilleux;
- U.S. Pat. No. 4,892,292, which issued Jan. 9, 1990 to Russell;
- U.S. Pat. No. 4,958,807, which issued Sep. 25, 1990 to Wylie;
- U.S. Pat. No. 5,255,899, which issued Oct. 26, 1993 to von Grozny,
- U.S. Pat. No. 5,617,697, which issued Apr. 8, 1997 to Erwin;
- U.S. Pat. No. 5,704,188, which issued Jan. 6, 1998 to Coulis;
- U.S. Pat. No. 5,709,366, which issued Jan. 20, 1998 to Speece;
- U.S. Pat. No. 5,722,205, which issued Mar. 3, 1998 to Gannaway; and
- U.S. Pat. No. 5,862,642, which issued Jan. 26, 1999 to Erwin;

Similar means for supporting posts, although not fence posts, have been shown in the following patents:

- U.S. Pat. No. 4,520,985, issued Jun. 4, 1985 to Blumenthal;
- U.S. Pat. No. 4,939,877, issued Jul. 10, 1990 to Claffey; and
- U.S. Pat. No. 5,305,976, which issued Apr. 26, 1994 to Blanchard.

The Erwin '697 patent shows a hollow plastic deck post supported by an internal square metal tube; this tube only contacts one side of the post and so gives limited support for the post. The Erwin '642 patent shows an improved design where the internal support is shaped so as to contact two corners of the post. This support is a special trapezoidal metal element, and is used along with wooden blocks; i.e. the support is not a commonly available hardware item.

The patents to Caron and Russell are similar to each other, and both show hollow circular posts supported by internal support members in the form of steel pipes or bars fixed to a base, the posts being joined to the pipes or bars by spacers in the form of plain tubular members. The rails are attached to the posts by fittings which resemble right angled pipe fittings. The tubular spacers provide little space between the circular posts and the pipes.

The Fornells, Moschner, and Wylie patents also show hollow plastic posts supported by a rod or pipe, but here the means connecting each rod or pipe to the post are integrally formed with the post, so that the post is not a simple tube. In Moschner the post is not extrudable, and needs to be molded.

The patent to Fornells also shows a relatively complex arrangement for attaching the rails to the posts, which allows the angle of inclination of the rails to be varied.

The von Grozny patent shows a hollow post supported by a ground-engaging spike via a settable material which is poured into the post; the settable material is required to take up a large amount of space within the post. Coulis shows a spring clip formed of wire for spacing a support pole inside a hollow post, which would be a more expensive item to make than a simple extrusion.

Much of this prior art shows constructions which are somewhat complex and expensive, especially in relation to the connections between posts and rails, and in requiring special parts which cannot be extruded.

Another problem with much of the prior art is that the parts which need to be provided to the installer include special internal support means. Such support means may be of special design, as shown in the patents of Speece, Gannaway, Veilleux, Erwin '642, Blumenthal, and Blanchard. In other cases, a simple tube or spike may be used, as in Caron, Russell, or Claffey, but this must fit exactly into the post part, making it doubtful if a common off-the-shelf pipe or spike would be satisfactory.

The present invention provides a construction in which cost is minimised, firstly by having major parts of the railing or fencing system, including the spacers which locate the posts on a supporting tube, formed of simple extrudable parts, usually of plastic, and secondly by having very simple connections between the posts and rails which do not require any special components. Furthermore, the parts allow the use of internal supports means, specifically metal pipes, which do not have to be a precise fit in the extruded parts, and so can be pipes of the type commonly available from hardware stores.

SUMMARY OF THE INVENTION

In the present invention, hollow (i.e. tubular) extruded plastic posts are used which have an internal cavity of constant cross-section; usually the posts are square. The posts are supported by internal support members in the form of cylindrical metal pipes having an upper portion extending within an internal cavity of one of the posts while a lower portion of the same pipe extends below a lower end of the post and is adapted to be fixed in vertical position. The rails, which are narrower in plan view than the posts, are connected to the posts simply by routing apertures in the side walls of the posts. The routing may be done by an installer, in accordance with site or customer requirements.

The nature of the joints between connecting posts and rails necessitates that, to prevent dislocation of the joints, there be sufficient overlap between the outer sides of the posts and the inner ends of the rails. If, for example, the simple tubular spacers used by Caron or Russell were to be used with apertures in the post walls to receive ends of the rails, the rails would not project sufficiently far into the posts to be secure.

Accordingly, the present invention also provides a spacer for connecting the support members to the posts in a manner which allows rails to project sufficiently into apertures in the post sidewalls to be secure. The spacer is integrally formed by extrusion of plastic material member and has:

a tubular portion suitable for providing an interference fit onto the supporting pipe, and longitudinal ribs projecting outwardly from the tubular portion and suitable for firm engagement within the side wall of one of the posts and which provide a clear space of at least one-half inch between the post side wall and the pipe at the locations of apertures made in the post to receive the rails.

In order to provide a suitable firm engagement between the pipe and the spacer, the tubular portion of each spacer has circumferentially spaced internal surface portions suitable for contacting the pipe at spaced locations around the pipe, the tubular portion having flexibility to allow distortion of its shape so that the internal surface portions can positively locate on pipes of slightly differing dimensions. Preferably, four of the internal surface portions are spaced generally evenly around the internal surface of the tubular portion and each are positioned between a pair of the longitudinal ribs.

The tubular portion may be cylindrical, in which case the internal surface portions are ribs projecting inwardly from the tubular portion. Alternatively, the tubular portion, when seen in cross-section, may be in the form of a hollow square with the ribs projecting from the corners of the square, and central areas of the sides of the tubular portion may provide the internal surfaces which contact the pipe. In each case the distortion which occurs when the internal surfaces are pushed outwardly by contact with the pipe have little effect on the diameter of the tubular portion at the bases of the ribs.

The longitudinal ribs extending outwardly from the tubular portion all lie in mutually perpendicular planes, and preferably the ribs each have an outer edge with at least one side flange, each side flange having an outer surface lying at an angle of between 45° and 90° to the respective rib, the side flanges being solid in cross-section and having a thickness of less than 0.15 inches to allow the side flanges to bend by contact with an inside surface of the post cavity and thus to provide an interference fit therewith. The flanges preferably have a thickness of between 0.08 and 0.13 inches.

Where the spacer is for use in a post having a cavity of square cross section, the outer surface of each flange lies at an angle of between 50 and 65° to the respective rib. Preferably each rib has a pair of flanges in arrowhead formation, and the angle between the outer surfaces of the adjacent flanges is between about 100 and 130°, and usually between 110 and 120°.

A similar spacer may be used for posts of circular cross section, but here the side flanges will project from the ribs at an angle close to 90°, so as to be slightly bent when forced into the circular post.

BRIEF DESCRIPTION OF THE DRAWINGS

Preferred embodiments of the invention will now be described by way of example with reference to the accompanying drawings, in which.

DETAILED DESCRIPTION

Figures 1, 1A:
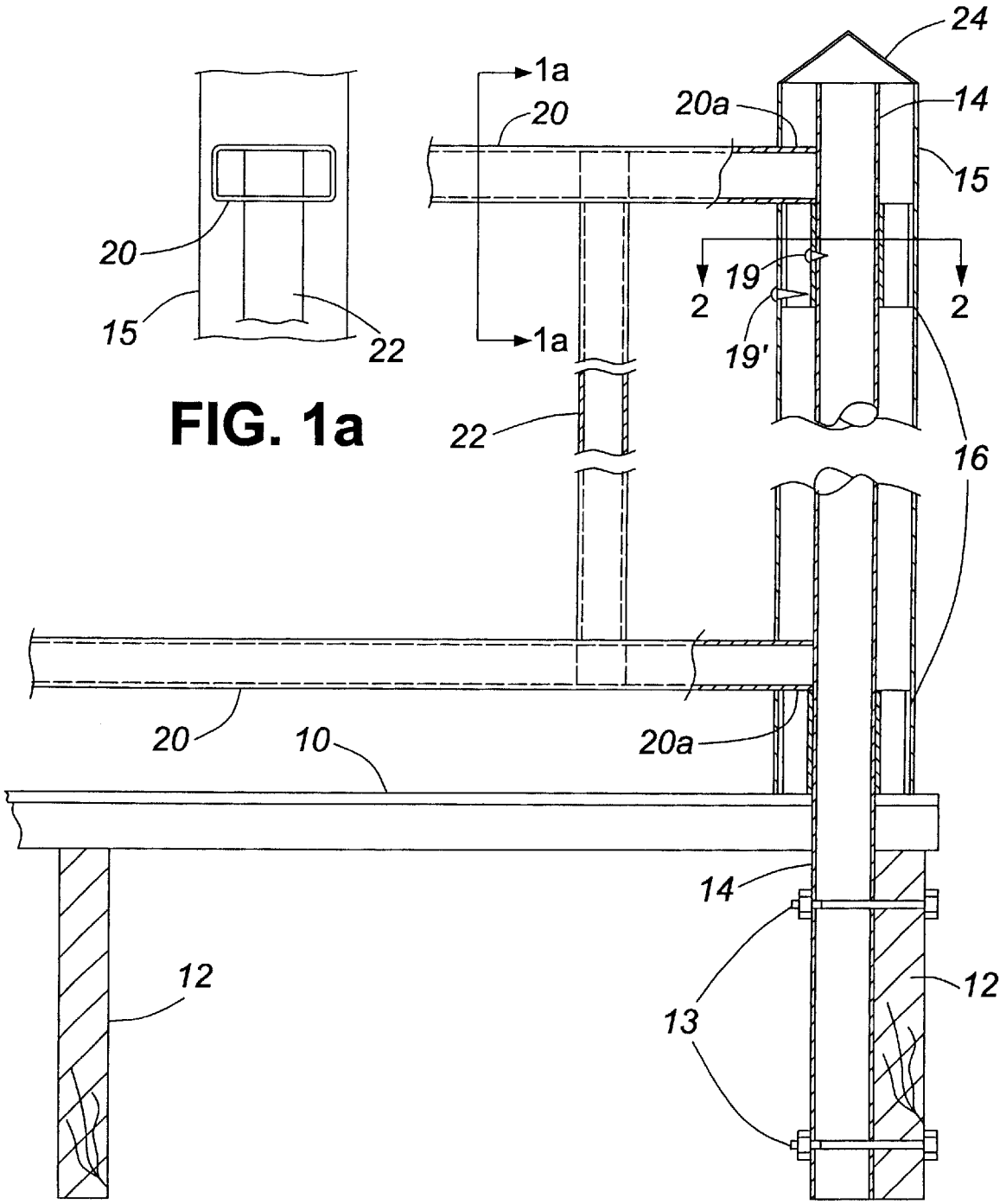
FIG. 1 is a sectional elevation of a deck railing post incorporating one form of the invention, and showing end portions of two rails.
FIG. 1*a* is a fragmentary view on line 1*a*—1*a* of FIG. 1.

FIG. 1 shows a wooden deck 10 of standard construction supported on vertical joists 12 of 2 inch by 10 inch timber. At spaced intervals, the joists 12 at the outside of the deck have fixed to them a lower portion of a tube or pipe 14, secured by bolts 13 passing through drilled bores in the pipe and through the adjacent joist. This pipe 14 is a 1⅞ inch diameter galvanized steel pipe of constant cross-section, readily available to builders, and has suitable strength for supporting a railing post. The pipe 14 has an upper portion extending up through the deck, where it is received in the center of a hollow post 15. In the construction shown, the pipe 14 extends up the major part of the height of the post, which will normally be about 2½ or 3 feet above the deck level.

The post 15 is of constant square cross-section, of about 4 inch width, and has its flat side walls joined by rounded corners. It is preferably formed integrally by extrusion from plastic material. The pipe 14 supports the post by the intermediary of upper and lower spacers 16, the cross-sectional form of which is shown in detail in FIG. 2. As shown, each spacer includes an inner, cylindrical, tubular portion 16*a* which snugly receives the pipe 14, and four external ribs 16*b* projecting radially outwardly from the tubular portion in mutually perpendicular planes. Each rib has an outer edge provided with pair of flanges 17 which are oriented in arrowhead formation with respect to the adjacent rib. When undeformed, i.e. before insertion into the post, the outer surfaces of the flanges 17 subtend between 45 and 90° to the respective rib. When designed for a square post as shown, the undeformed flanges have between them an angle of greater than 90°, preferably between 100° and 130°, i.e. each lies at and angle of between 50 and 65° to the adjacent rib. In practice the angle between the flange outer surfaces is between about 110 and 120°.

The arrangement of the ribs 16*b* and flanges 17 is such as to make the spacer an interference fit into the post, with the flanges flexing to take care of minor inconsistencies with the internal measurements of different posts and always ensuring a firm fit with no play. In order to be sufficiently flexible, the flanges are relatively thin and solid, with no hollow cavities, being less than 0.15 inches thick, and preferably less than 0.125 inches thick, and are also greater in thickness than 0.050 inches.

In addition to the ribs 16*b*, the tubular portion 16*a* of each spacer has series of small longitudinal internal ribs which provide internal surface portions which ensure an interference fit on the pipe 14. Four such surface portions are provided, in the form of three single ribs 18*a*, 18*b*, and 18*c* which are equally spaced between pairs of the outer ribs 16*b*, and on a fourth side of the spacer there is provided a fourth surface portion in the form of a closely spaced pair of the internal ribs 18*d*, one at each side of a central depression which receives a screw 19. The fact that these ribs provide internal surface portions which lie mid-way between the external ribs 16*b* means that if the shape of the tubular portion is distorted by being fitted onto a slightly over-size pipe this does not much affect the positions of the bases of the ribs 16*b*, i.e. where these ribs connect to the tubular portion, and thus do not much affect the fit of the spacer within the post.

Although the spacers are an interference fit both with the post and the pipe, preferably the upper spacer is fixed both to the post and to the pipe 14 so that the post cannot easily be removed. For this purpose, after the spacers have been positioned on the pipe, and before the post is positioned, bores are drilled radially through the tubular portion of the spacer 16 and the pipe 14 in a location between the pair of internal ribs 18*d*, and a screw 19 is inserted. For this purpose, it is highly advantageous that the spacer be an interference fit on the pipe, as provided by the internal ribs, since this holds the spacer in position until the screw 19 has been inserted.

Figure 2:
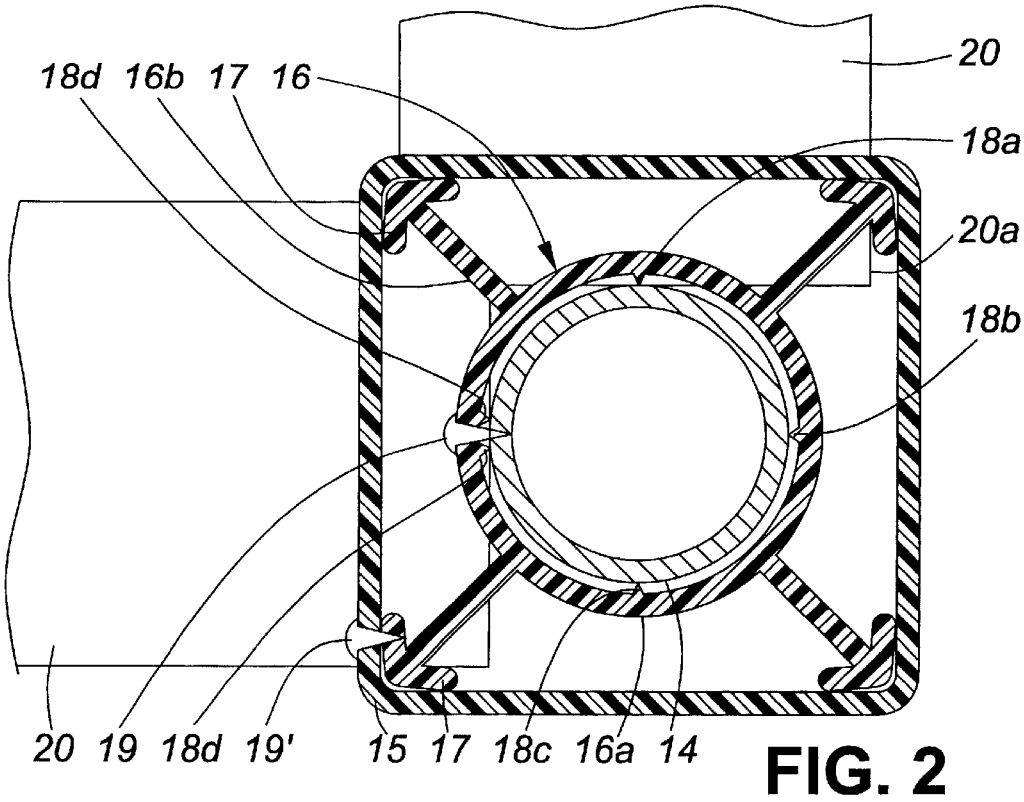
FIG. 2 is a cross-sectional plan view on lines 2—2 of FIG. 1.

After the post 15 has been put in place, this is secured to the spacer by means of a second screw 19' which is inserted through a hole drilled near the corner of the post and into a flange 17 of the spacer, as indicated in FIG. 2. The presence of the spacer rib flange near to the side wall of the post is advantageous for this fixing operation, since a screw could not easily be inserted directly into the rib. This operation, in effect, fixes the post to the pipe.

The railing system also includes horizontal rails 20 of known rectangular form and having a width of 3⅜ inches and a height of 1¾ inches, and pickets 22 which are square sections of 1½ inch width. Both the rails and the pickets are hollow and are formed from plastic by extrusion. The rails have their end portions 20*a* inserted into apertures cut in the sides of posts by a router, in accordance with customer requirements. Conveniently, the spacers 16, which in this embodiment would interfere with the end portions 20*a* of the rails, are positioned just below the end portions. Also, the rails 20 have their end portions 20*a* bevelled at one side, as shown in FIG. 2, where these are required to meet on a corner. The pickets 22 are assembled by having their upper and lower end portions inserted into suitable apertures in the tops and bottoms of the rails. The spacers 16 provide a clear space of over ¾ inch, in fact about ⅞ inch, adjacent the of the post side wall, in between the inner surfaces of the post side walls and the outer surface of the pipe 14. In proportional terms, the clear overlap space is more than 20% of the post width.

Finally, the posts are fitted with conventional caps 24 at their top ends.

Figure 4:
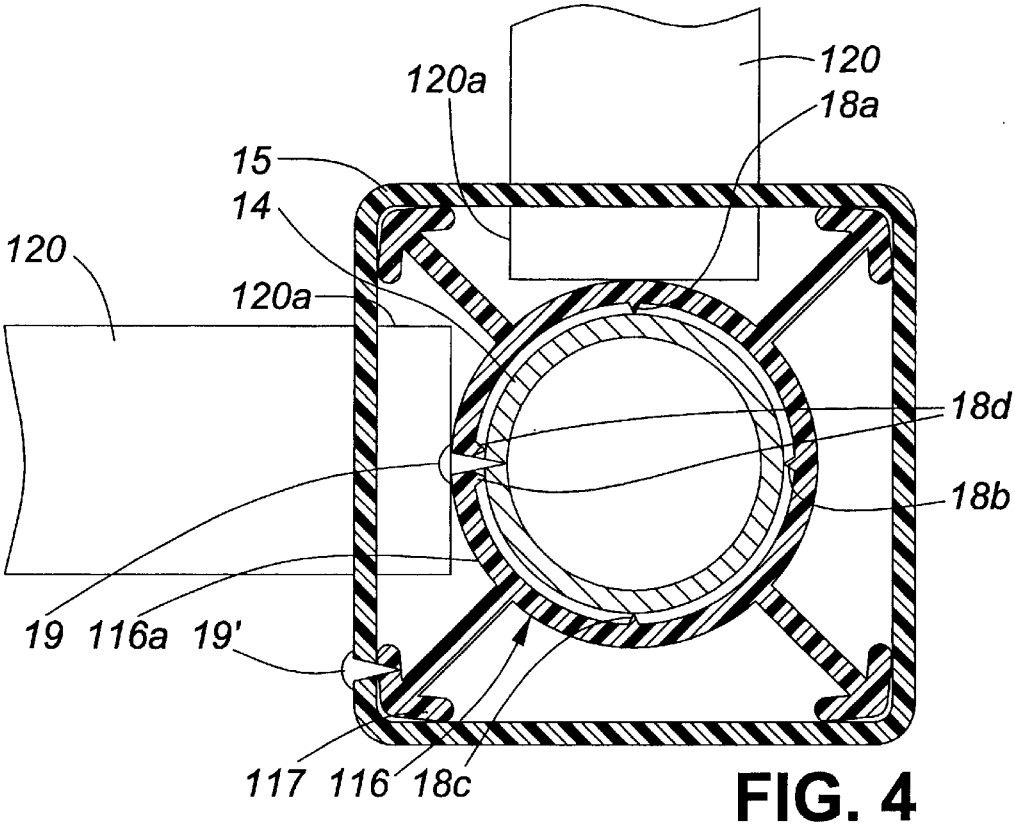
FIG. 4 is a cross-sectional view on lines 4—4 of FIG. 3.
Figure 3:
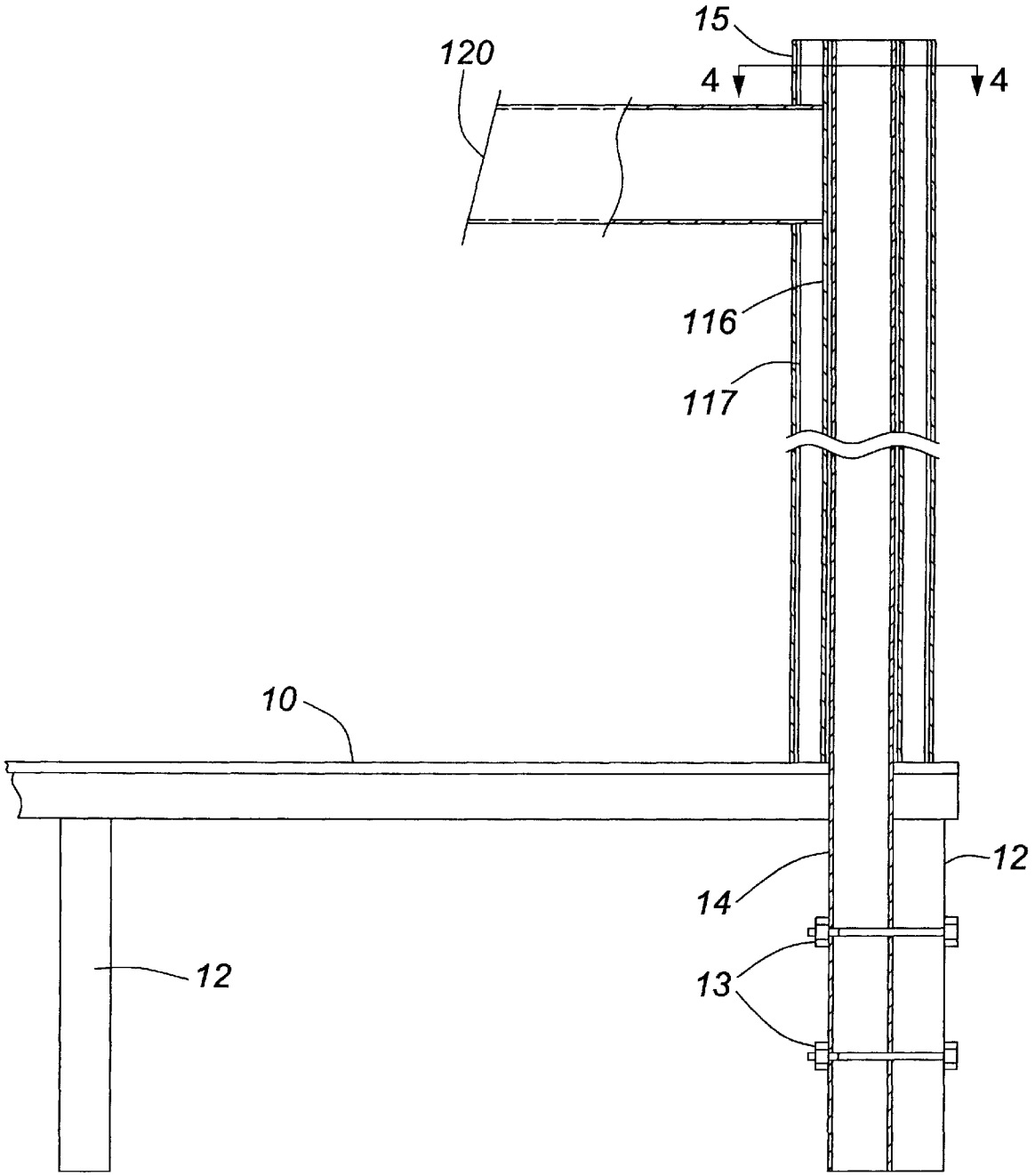
FIG. 3 is a view similar to FIG. 1 of an alternative construction.

Referring to FIGS. 3 and 4, these show a variation of the invention in which the rails 120 are vertically elongated, being 3½ inches high and 1½ inches wide, and are used without pickets. In this construction the rail end portions 120*a* are centered on the sides of the posts and do not interfere with the ribs of the spacer 116. This spacer has the same cross-section as the spacer 16 previously described, but it is longer and can extend past the inner end portions of the rails. It has ribs with end flanges 117, similar to flanges 17. The rails 120 in this case are butted against the sides of the tubular portion 116*a*, but this still allows a clear space for the rail end portions 120*a* to overlap within the post side wall, this space being more than ½ inch, actually about ⅝ inch, so that a secure fitting is produced. The relationship of the spacer 116 and the rail end portions here means that the spacer can extend up the entire length of post which is above the deck 10, as shown in FIG. 3. The spacer is secured in similar manner as before with screws 19 and 19'.

Figure 5:
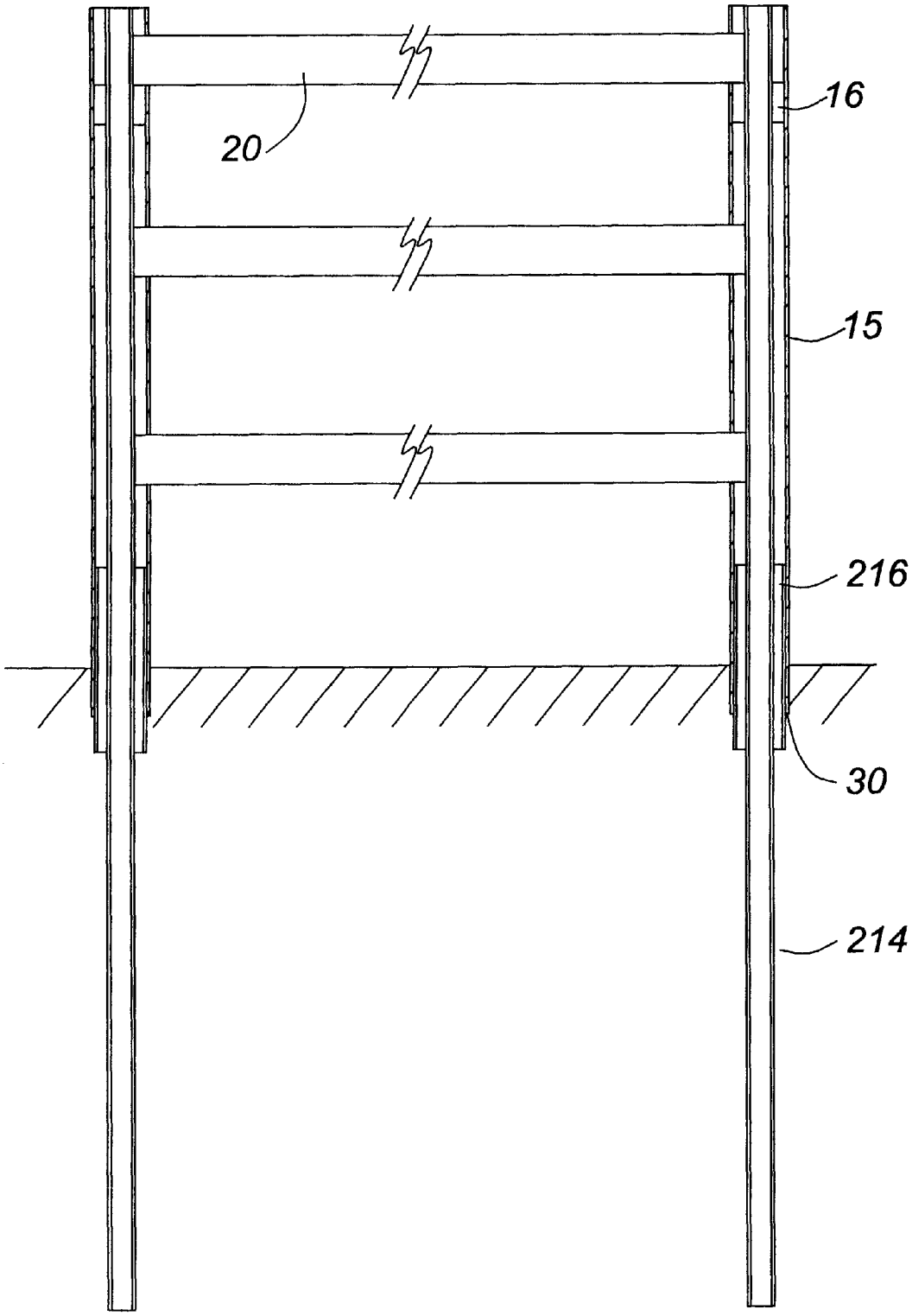
FIG. 5 is a sectional elevation of a fence post with portions of railings attached.

FIG. 5 shows the same basic combination of square plastic extruded post 15, rectangular extruded rails 20, and spacers being used to form a fencing system. The fence is assembled by first forming a relatively small fence hole 30, about 8 inches deep, and then driving a steel pipe 214 into the center of the hole and then down several feet into the earth. The pipe 214 is a 1⅞ inch galvanized pipe as before but longer, suitably about 7 or 8 feet in length. The ground around the pipe is then dug away to provide a hole having a depth of about 8 inches, large enough to receive a lower end portion of the post. A long spacers 216 having the same cross-section as that shown in FIG. 2 but with a length of about 12 inches is then slid over the pipe 214 and driven into the ground to about one-half its length. The presence of the long spacer 216 in the hole increases the effective diameter of the support at this point and thus increases its resistance to sideways movement in the ground. A short spacer 16 which is the same as those of FIGS. 1 and 2 is then positioned as shown just below where the top rail 20 is to be placed. These spacers are secured to the pipe with screws as previously described. The post 15 is then placed over the pipe 214 and the spacers 16 and 216, and its lower end is driven into the hole 30 to a depth of about 4 inches, and secured to the spacers by screws. Following this, the ends of rails 20 are mated with apertures routed in the sides of the post as described with reference to FIGS. 3 and 4.

Figure 6:
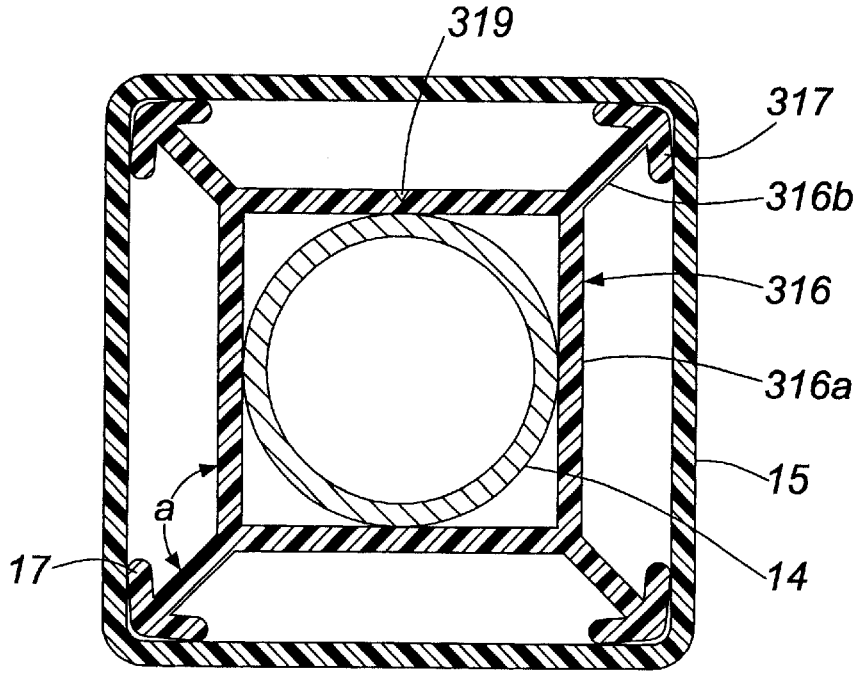
FIG. 6 is a view similar to FIG. 4 of square post fitted with a modified form of spacer.

FIG. 6 shows a preferred form of spacer 316, in which the inner tubular portion 316*a* is square, rather than circular in cross-section as before. This allows the spacer to be fitted onto the pipe 14 more easily while gripping the pipe when in place, since the central areas of the flat sides of portion 316*a* now form spaced internal surfaces which can flex outwards when the spacer is pushed onto the pipe; this obviates the need to provide internal protrusions such as items 18*a*, 18*b*, etc. in FIG. 2. The ribs 316*b* project outwards from the corners of the portion 316*a* at mutually perpendicular angles indicated at "all" which subtend 135° to the flat sides of the tubular portion; the base positions of these ribs are little affected if the tubular portion of the spacer is distorted by being pushed onto an over-size pipe. One side of portion 316*a* has a central screw marker 319; another advantage of this square type spacer is that the hole for screw 19 is drilled into a flat surface.

Figure 7:
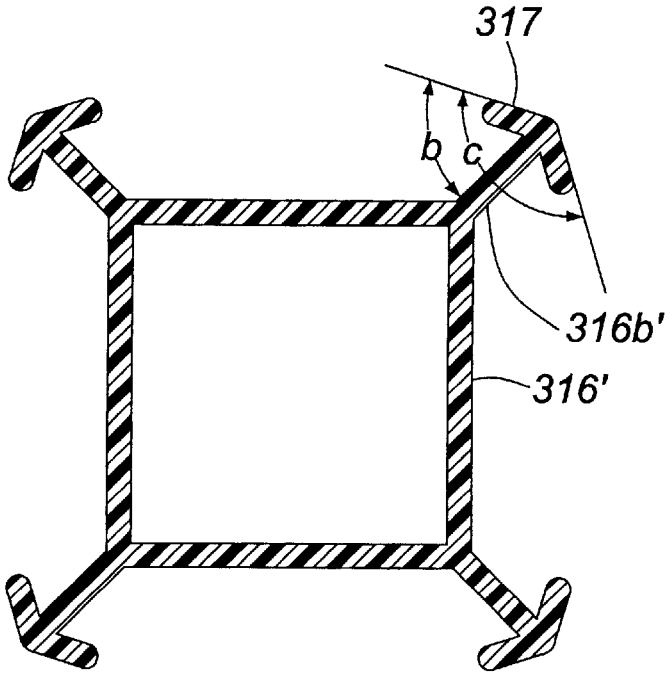
FIG. 7 is a cross-sectional view of a spacer similar to that of FIG. 6 designed for a larger post.

FIG. 6 shows the flanges 317 distorted by having been inserted into the post 15, but FIG. 7, which shows a similar spacer 316' for a larger post, shows the undeflected form of the flanges 317. FIG. 7 shows that the angle "b" between the outer surface of each of the flanges 317 and the adjacent side of the rib 316*b'* is about 55°, and preferably between 50 and 65°. The angle "c" between the outer surfaces of the flanges 317 is between 100 and 130°, and preferably between 110 and 120°.

Figure 8:
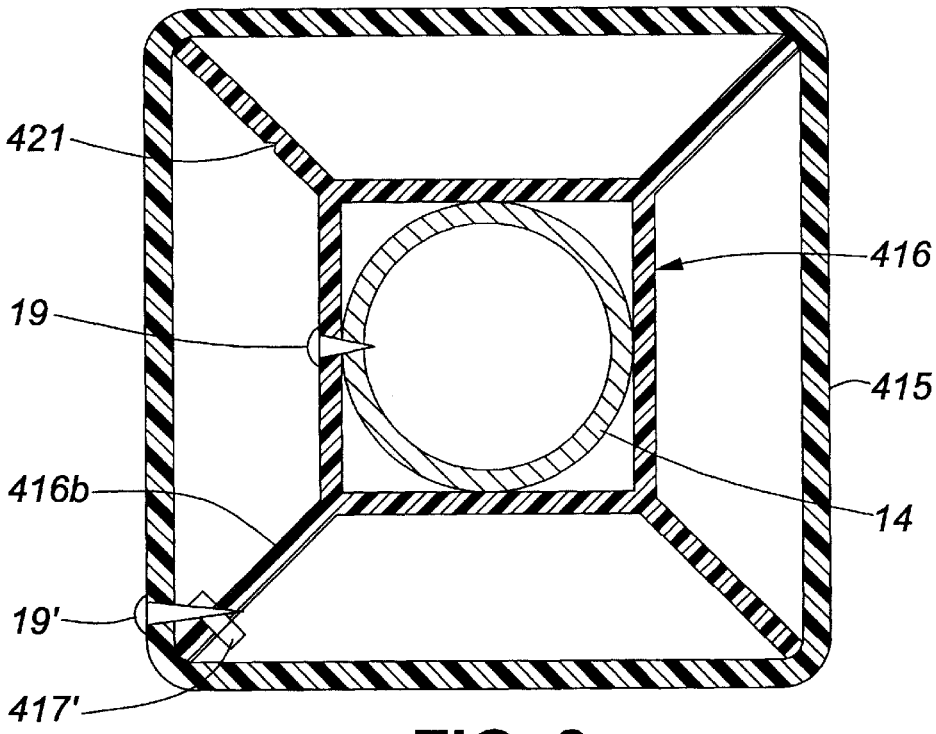
FIG. 8 is a view similar to FIG. 6 of a large post with yet another design of spacer.

FIG. 8 shows a spacer 416 similar to that of FIG. 7, installed in a post 415, but in which the outer edges of the ribs 416*b* do not have the arrowhead formation of side flanges shown previously. It has been found that when using the spacers with a square tubular portion, the side flanges are not necessary. However, a small flange 417' is provided on one of the ribs 416*b* so that the end of a screw 19' inserted through a corner portion of the post locates on the junction between the rib and the flange.

The tubular portion of each spacer 416 having four internal surface portions suitable for gripping one of the metal pipes 14 at spaced locations around the pipe. The internal surface portions are evenly spaced around an interior of the tubular portion and each being located midway between a pair of the ribs 416*b*.

It has been found, in practice, to be difficult to extrude the spacers of this invention which are perfectly symmetrical; in some cases the ribs are found to be not quite equal in length. In order that a post may fit easily onto several spacers which are slightly unsymmetrical, it is desirable that the spacers should have an alignment marker to ensure that all the spacers placed onto a support will have their longest and shortest ribs aligned. FIG. 8 shows an example of such an alignment marker in the form of a small groove 421 in the side of one of the ribs 416*b*.

Figure 9:
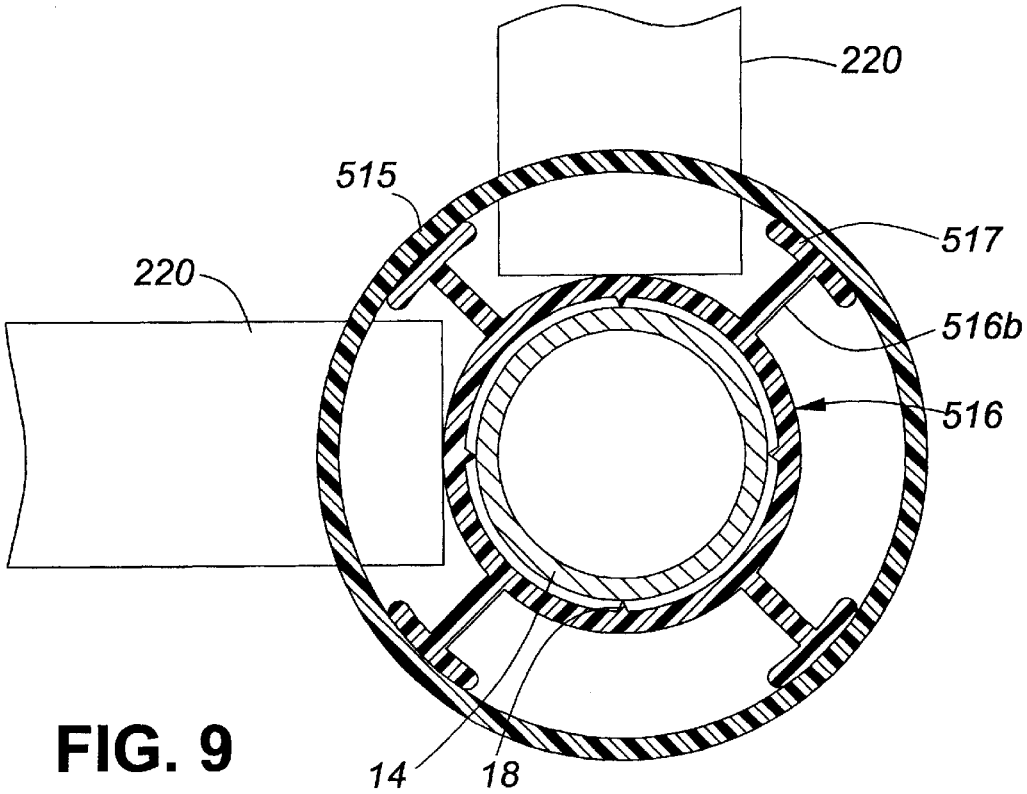
FIG. 9 is a view similar to FIG. 4 of a variation using a circular post.

FIG. 9 shows a variation using a circular post 515. The spacer 516 used in this case is similar to spacer 16 initially described, except that the flanges 517 on the outer edges of the ribs 516*b* project at an angle of close to 90° from the ribs, in practice between about 80 and 90°, so that their outer edges make contact with the interior of the circular post and provide an interference fit in the post cavity. As before, the sides of the post are routed to provide apertures for the rails 220.In FIG. 9 these are shown terminating at the spacer, but in many cases the spacer will be used below the rails so that these can extend fully to the support pipe 14. Also as before, the spacer has internal ribs 18 which grip the pipe 14. Clearly, other shapes of post could be used, such as hexagonal or polygonal, in which case the spacers would have more than four ribs.

It will be seen that the spacer provided in accordance with this invention allows a well supported plastic railing or fence system to be assembled with a few commonly available parts, such as the pipes 14 or 214, and the special spacers 16, 116, 316, 416 and 516 which can be formed by extrusion and are only required to be used in short lengths, as in FIG. 1. The parts supplied to the installer do not need to include the supporting pipes since these are commonly available, and the system can accommodate slightly varying dimensions in such pipes.

I claim:

1. A post and rail system, comprising:

a plurality of extruded tubular posts of plastic material, each said post having uniform internal dimensions and having an integrally formed sidewall of generally constant wall thickness, said sidewall defining an internal cavity and having apertures leading into said cavity;

rigid support members comprising cylindrical metal pipes, each of the members having upper and lower end portions, the upper end portion respectively extending within said internal cavity of said tubular posts while the lower end portion respectively extends below a lower end of said posts and said lower end portion is adapted to be fixed in a vertical position;

spacers extruded from plastic and located wholly within said posts, each spacer having a tubular portion sized to snugly receive one of said metal pipes, and each spacer having four longitudinal ribs projecting outwardly from the tubular portion and suitable for firm engagement within said internal cavity, said ribs being perpendicular to each other when seen in cross-section, said ribs providing a clear space of at least one-half inch adjacent the interior of the post sidewall at the locations of said apertures;

said tubular portion of each spacer having four internal surface portions suitable for gripping one of said metal pipes at spaced locations around the pipe, said internal surface portions being evenly spaced around an interior of the tubular portion and each being located midway between a pair of said ribs, the tubular portion having flexibility to allow distortion of its shape so that said internal surface portions can positively locate on pipes of slightly varying dimensions;

said system also including normally horizontal rails supported between said posts and extending into said apertures in the sidewalls of said posts, each said rail including an end portion which extends beyond internal surfaces of a post sidewall and towards said metal pipe;

and wherein said rails include upper rails and lower rails, and said spacers being positioned to support the posts at locations both at bases of the posts and adjacent said upper rails.

2. A post and rail system according to claim 1, wherein said tubular portion of the spacer is cylindrical, and the internal surface portions are ribs projecting inwardly from said tubular portion.

3. A post and rail system according to claim 1, wherein said tubular portion of the spacer, in cross section, is in the form of a hollow square having sides with central areas which provide said internal surface portions which contact the pipe, and wherein said ribs project from each of the four corners of said hollow square tubular portion.

4. A post and rail system, comprising:

a plurality of extruded tubular posts of plastic material, each said post having uniform internal dimensions and having an integrally formed sidewall of generally constant wall thickness, said sidewall defining an internal cavity and having apertures leading into said cavity;

rigid support members comprising cylindrical metal pipes each of the members having upper and lower end portions, the upper end portion of each member extending within said internal cavity of one of said tubular posts while the lower end portion respectively extends below a lower end of the said one post and said lower end portion is adapted to be fixed in a vertical position;

spacers extruded from plastic and located wholly within said posts, each spacer having a tubular portion sized to snugly receive one of said metal pipes, and each spacer having longitudinal ribs projecting outwardly from the tubular portion and suitable for firm engagement within a said internal cavity of said posts and which provide a clear space of at least one-half inch adjacent the interior of the post sidewall at the locations of said apertures;

said tubular portion of each spacer having circumferentially spaced internal surface portions suitable for gripping one of said metal pipes at spaced locations around the pipe, said internal surface portions each being located between a pair of said ribs, the tubular portion having flexibility to allow distortion of its shape so that said internal surface portions can positively locate on pipes of slightly varying dimensions;

said system also including normally horizontal rails supported between said posts and extending into said apertures in the sidewalls of said posts, each said rail including an end portion which extends beyond internal surfaces of a post sidewall and towards said metal pipe;

said rails including upper rails and lower rails, and said spacers being positioned to support the posts at locations both at bases of the posts and adjacent said upper rails;

wherein said spacers are short in relation to the posts, and wherein said internal surface portions are adapted to grip the pipe firmly before the spacer is fixed, as by screw means, to the pipe.

5. A post and rail system according to claim 1, wherein said posts are of generally square cross-section, and wherein the ribs of said spacers each have an outer edge with at least one side flange extending at an angle of between 45° and 90° to the rib, and such that the flanges are caused to bend by contact with inner corners of said internal cavity of said post which are a close fit onto outer edges of the ribs, whereby said flanges provide an interference fit between the spacer means and the post.

6. A post and rail system according to claim 5, wherein each said rib terminates in a pair of said side flanges which project from the outer edges of the ribs in arrowhead formation.

7. A post and rail system according to claim 1, wherein said internal cavity of the post is of circular cross section, and wherein each said rib terminates in a pair of side flanges which project from outer edges of the ribs at an angle of close to 90°.

8. A post and rail system comprising:

a plurality of extruded tubular posts of plastic material, each said post having uniform internal dimensions and having an integrally formed sidewall of generally constant wall thickness, said sidewall defining an internal cavity of generally square cross-section and having apertures leading into said cavity;

rigid support members comprising cylindrical metal pipes each of the members having upper and lower portions, the upper portion of each member extending within an internal cavity of one of said tubular posts while the lower end portion respectively extends below a lower end of the said one post and said lower end portion is adapted to be fixed in a vertical position;

spacers of extruded plastic material for locating said support members inside the posts, each spacer having a tubular portion and four longitudinal ribs each extending outwardly from said tubular portion, said ribs lying in mutually perpendicular planes, said ribs each having an outer edge engaging in a corner of a said internal cavity, and wherein an outer edge portion of one of a said ribs has a flange projecting outwards from the plane of the rib;

a screw inserted through an outer corner portion of each post and passing into said flange to fix the spacer within the post;

said system also including normally horizontal rails supported between said posts and extending into said apertures in the sidewalls of said posts, each said rail including an end portion which extends beyond internal surfaces of a post sidewall and towards said metal pipe.

9. A post and rail system according to claim 8, wherein the flange at the outer edge of the spacer rib is constituted by a side flange projecting at an angle of between 50° and 65° to the side of the said rib, said side flange having a thickness allowing it to bend by contact with an inside surface of said internal cavity of the post and thus to provide an interference fit therewith.

10. A post and rail system according to claim 8, wherein said flange at the outer edge portion of said spacer rib is spaced from the outer edge of the rib so that the end of said screw when inserted through said outer corner portion of the post locates on the junction between the rib and said flange, the head of the screw being on the outside of said corner portion.

11. A post and rail system according to claim 8, wherein the tubular portion of each said spacer is fixed to said metal pipe by means of a screw passing through the tubular portion and into the pipe.

* * * * *